US011351076B2

(12) United States Patent
Yen

(10) Patent No.: US 11,351,076 B2
(45) Date of Patent: Jun. 7, 2022

(54) AIR MATTRESS CONTROL SYSTEM

(71) Applicant: Brilliant Product Design Co., Ltd., Taipei (TW)

(72) Inventor: Ying-Chun Yen, Taipei (TW)

(73) Assignee: Brilliant Product Design Co., Ltd., Taipei (TW)

( * ) Notice: Subject to any disclaimer, the term of this patent is extended or adjusted under 35 U.S.C. 154(b) by 344 days.

(21) Appl. No.: 16/669,186

(22) Filed: Oct. 30, 2019

(65) Prior Publication Data

US 2020/0405071 A1 Dec. 31, 2020

(30) Foreign Application Priority Data

Jun. 27, 2019 (TW) ..... 108122698

(51) Int. Cl.
*A61G 7/057* (2006.01)
*A47C 27/08* (2006.01)
(Continued)

(52) U.S. Cl.
CPC ..... *A61G 7/05769* (2013.01); *A47C 27/082* (2013.01); *A47C 27/083* (2013.01);
(Continued)

(58) Field of Classification Search
CPC ..... A47C 27/082; A47C 27/083; A47C 27/10; A61G 7/001; A61G 7/05769; A61G 2203/34
(Continued)

(56) References Cited

U.S. PATENT DOCUMENTS 5,606,754 A * 3/1997 Hand ..... A61G 7/05776 5/713
2004/0163181 A1 8/2004 Wu
(Continued)

FOREIGN PATENT DOCUMENTS

CN 106389039 A 2/2017
CN 106442031 A 2/2017
(Continued)

OTHER PUBLICATIONS

Office Action of corresponding CN application 201910859153.4, published on Jun. 17, 2021.
(Continued)

*Primary Examiner* — Michael Safavi
(74) *Attorney, Agent, or Firm* — Wang Law Firm, Inc.

(57) ABSTRACT

An air mattress control system is disclosed. The air mattress control system comprises a mattress and a gas regulating device. The mattress comprises a plurality of inflation layers. The gas regulating device comprises a first three-way solenoid valve, a pumping motor, a second three-way solenoid valve, a connecting conduit, a gas guiding device, and a control device. The pumping motor connects the first three-way solenoid valve and the second three-way solenoid valve connects the pumping motor. The connecting conduit connects the first three-way solenoid valve and the second three-way solenoid valve. The gas guiding device connects the connecting conduit and a plurality of the inflation layer. The control device controls the switch of the first three-way solenoid valve and the second three-way solenoid valve, and starting the pumping motor to inflate or deflate the plurality of inflation layers.

12 Claims, 5 Drawing Sheets

(51) Int. Cl.
*A47C 27/10* (2006.01)
*A61G 7/00* (2006.01)

(52) U.S. Cl.
CPC ..... *A47C 27/10* (2013.01); *A61G 7/001* (2013.01); *A61G 2203/34* (2013.01)

(58) Field of Classification Search
USPC ..... 5/615, 689, 706, 707, 710, 713, 715
See application file for complete search history.

(56) References Cited

U.S. PATENT DOCUMENTS

| | | | | |
|---|---|---|---|---|
| 2010/0281619 | A1* | 11/2010 | Beck | A61G 7/05776 5/713 |
| 2014/0223665 | A1 | 8/2014 | Chapin | |

FOREIGN PATENT DOCUMENTS

| | | | | | |
|---|---|---|---|---|---|
| CN | 106491294 | A | * | 3/2017 | |
| CN | 108309604 | A | | 7/2018 | |
| CN | 109330794 | A | | 2/2019 | |
| CN | 109480534 | A | | 3/2019 | |
| GB | 2169195 | A | * | 7/1986 | A61G 7/05769 |
| TW | M584636 | U | | 10/2019 | |
| WO | WO-2018032089 | A1 | * | 2/2018 | A61B 5/7275 |
| WO | WO-2021042681 | A | * | 3/2021 | A61G 7/05784 |

OTHER PUBLICATIONS

Notice of Office Action of corresponding TW application 108122698, published on Feb. 19, 2020.
Office Action of corresponding CN application 201910859153.4, published on Sep. 29, 2021.

* cited by examiner

AIR MATTRESS CONTROL SYSTEM

CROSS-REFERENCE TO RELATED APPLICATION

This application claims priority from Taiwan Patent Application No. 108122698, filed on Jun. 27, 2019, in the Taiwan Intellectual Property Office, the content of which is hereby incorporated by reference in its entirety for all purposes.

BACKGROUND OF THE INVENTION

1. Field of the Invention

The present invention relates to a mattress system, and more particularly to an air mattress control system.

2. Description of the Related Art

Bedridden patents usually have their skin tissue under stressed for a long time and suffer from impaired skin integrity. Specifically, the stress to the skin tissue will hinder the blood flow of the arteries for supplying the blood to the skin tissue which may lead to the lack of oxygen and resulting in releasing some chemical substances. Particularly, the part of the skin tissue that the prominent bones or less fat region therein are prone to occur the blood flow obstruction situation due to the above mentioned stress, which easily leads to skin tissue necrosis. This situation is so called decubitus. Therefore, the medical-related industries have successively developed products, which assist the bedridden patients to turn their body over regularly and effectively prevent the patients from stay lying in bed without changing their posture.

The conventional device for assisting the patient to turn over is usually provided with parts driven and rotated by mechanical means to facilitate the turn-over movement of the turning device, so that the patient lying flat on the turning device can be turned over. However, this type of turning device is quite bulky and it is usually necessary to replace the original bed when replacing the turning device, which will result in additional costs for the hospital or clinic. In addition, some other conventional turning-over devices for assisting the patient to turn over may be provided with inflatable members, and the patient can be turned over by inflation of the inflatable member on one side. However, different inflatable members may need to be coupled and driven by different driving devices, and therefore again increases the cost.

For the purpose of improving the drawbacks of the prior art, the inventor of the present invention provides an air mattress control system aim to cure the deficiencies as discussed.

SUMMARY OF THE INVENTION

In view of the shortcomings of the prior art, an air mattress control system is provided to overcome the problem in the prior art. To achieve the foregoing objective, an air mattress control system is provided and comprises a mattress and a gas regulating device. The mattress comprises a plurality of inflation layers. The gas regulating device comprises a first three-way solenoid valve, a pumping motor, a second three-way solenoid valve, a connecting conduit, a gas guiding device, and a control device. The first three-way solenoid valve comprises three first input-output ports, the pumping motor is connected to the first three-way solenoid valve, the second three-way solenoid valve comprises three second input-output ports, the second three-way solenoid valve is connected to the pumping motor, the connecting conduit is connected to the first three-way solenoid valve and the second three-way solenoid valve, the gas guiding device is connected to the connecting conduit and the plurality of inflation layers, the control device is connected to the first three-way solenoid valve, the second three-way solenoid valve, the pumping motor and the gas guiding device, the control device controls the first three-way solenoid valve and the second three-way solenoid valve in order to make the pumping motor to inflate or deflate the plurality of inflation layers.

Preferably, the three first input-output ports may comprise a first valve hole disposed on one side of the first three-way solenoid valve, a second valve hole and a third valve hole disposed on one other side of the first three-way solenoid valve, the three second input-output ports comprises a fourth valve hole disposed on one side of the second three-way solenoid valve, a fifth valve hole and a sixth valve hole disposed on one other side of the second three-way solenoid valve, the first valve hole and the fourth valve hole are connected to the pump motor respectively, the second valve hole and the fifth valve hole are connected to ambient air respectively, and the third valve hole and the sixth valve hole are connected to the connecting conduit respectively.

Preferably, when the air mattress control system is in an inflation mode, the control device transmits an inflation signal to drive the first three-way solenoid valve to close the third valve hole and drive the second three-way solenoid valve to close the fifth valve hole, whereas the first valve hole and the second valve hole remain unblocked, and the fourth valve hole and the sixth valve hole remain unblocked, and the control device transmits the inflation signal to activate the pump motor, and the pump motor pumps the gas from the ambient air into the second valve hole and the gas is sequentially transmitted to the plurality of inflation layers via the first valve hole, the pump motor, the fourth valve hole, the sixth valve hole, the connecting conduit and the gas guiding device.

Preferably, when the air mattress control system is in a deflation mode, the control device transmits a deflation signal to drive the first three-way solenoid valve to close the second valve hole and drive the second three-way solenoid valve to close the sixth valve hole, whereas the first valve hole and the third valve hole remain unblocked, and the fourth valve hole and the fifth valve hole remain unblocked, and the control device transmits the deflation signal to activate the pump motor, and the pump motor pumps the gas from the plurality of inflation layers into the gas guiding device and the gas is sequentially transmitted to the ambient air via the connecting conduit, the third valve hole, the first valve hole, the pump motor, the fourth valve hole and the fifth valve hole.

Preferably, the air mattress control system may further comprise a smart electronic device coupled to the control device, the smart electronic device may transmit the inflation signal to the control device and the control device further transmits the inflation signal to drive the first three-way solenoid valve and the second three-way solenoid valve to make the air mattress control system enter the inflation mode. The smart electronic device may also transmit the deflation signal to the control device and the control device further transmits the deflation signal to drive the first three-way solenoid valve and the second three-way solenoid valve to make the air mattress control system enter the deflation mode.

Preferably, the gas guiding device may comprise a first two-way solenoid valve connected to the connecting conduit and the mattress respectively via two openings of the first two-way solenoid valve, a second two-way solenoid valve connected to the connecting conduit and the mattress respectively via two openings of the second two-way solenoid valve and a third two-way solenoid valve connected to the connecting conduit and the mattress respectively via two openings of the third two-way solenoid valve, the control device transmits a first control signal to drive the first two-way solenoid valve to open or block the two openings of the first two-way solenoid valve, the control device transmits a second control signal to drive the second two-way solenoid valve to open or block the two openings of the second two-way solenoid valve, and the control device transmits a third control signal to drive the third two-way solenoid valve to open or block the two openings of the third two-way solenoid valve.

Preferably, the air mattress control system may further comprise a first pneumatic sensing element connected to the first two-way solenoid valve, a second pneumatic sensing element connected to the second two-way solenoid valve and a third pneumatic sensing element connected to the third two-way solenoid valve, the first pneumatic sensing element detects the first two-way solenoid valve to generate a first air pressure message and further transmits to the control device, the second pneumatic sensing element detects the second two-way solenoid valve to generate a second air pressure message and further transmits to the control device and the third pneumatic sensing element detects the third two-way solenoid valve to generate a third air pressure message and further transmits to the control device.

Preferably, when the first air pressure message matches a first default message of the control device, the control device drives the second two-way solenoid valve and the third two-way solenoid valve to be closed, wherein when the second air pressure message matches a second default message of the control device, the control device drives the first two-way solenoid valve and the third two-way solenoid valve to be closed, wherein when the third air pressure message matches a third default message of the control device, the control device drives the first two-way solenoid valve and the second two-way solenoid valve to be closed.

Preferably, when at least one of the first air pressure message, the second air pressure message and the third air pressure message matches an abnormal signal of the control device, the control device drives the first two-way solenoid valve, the second two-way solenoid valve and the third two-way solenoid valve to be closed.

Preferably, the air mattress control system may further comprise a smart electronic device coupled to the control device, the control device transmits the first air pressure message, the second air pressure message and the third air pressure message to the smart electronic device and the smart electronic device may present the first air pressure message, the second air pressure message or the third air pressure message by text, picture, sound or a combination thereof.

Preferably, the plurality of inflation layers may comprise a first inflation layer connected to the first two-way solenoid valve, a second inflation layer connected to the second two-way solenoid valve and a third inflation layer connected to the third two-way solenoid valve.

Preferably, the second inflation layer may be disposed at one surface of the first inflation layer and arranged to be near one side of the first inflation layer, the third inflation layer may be disposed at the one surface of the first inflation layer and arranged to be near one other side of the first inflation layer.

As aforementioned, the air mattress control system disclosed in the present invention may be provided with one or more of the following advantages:

Compared with the conventional mattress system, the air mattress control system of the present invention, the control device is configured to control the first three-way solenoid valve and the second three-way solenoid valve in order to make the pumping motor to inflate or deflate the plurality of inflation layers. Only a single pumping motor is needed for changing the airflow path by opening or closing the valve hole, the installation cost of the motor device is reduced, the space occupied by the gas regulating device is reduced, and the inflation or deflation of the plurality of inflation layers can be effectively controlled.

The gas guiding device of the air mattress control system in the present invention could further comprise pneumatic sensing elements. By sensing the pressure information of inflation layers and comparing with the default message of the control device, the two-way solenoid valve is driven to close and to make sure that different inflation layers are not inflating at the same time, thereby preventing the inclined layer of the inflation layer from pinching the user lying therein and the safety of the patient is therefore guaranteed.

The control device of the gas guiding device of the air mattress control system in the present invention may further be controlled by the smart electronic device in order to switch the solenoid valve between different modes. After the mode is switched, there is no need to continue supplying the power to maintain the valve hole switch, which effectively reduces power consumption and prolongs the durability of the device.

For the purpose of explaining the aforementioned purposes, technical features, and improvements of the present invention more obvious and understandable, the details of the invention will be explained in the description of the preferred embodiments together with related drawings.

DETAILED DESCRIPTION OF THE PREFERRED EMBODIMENTS

Figure 1:
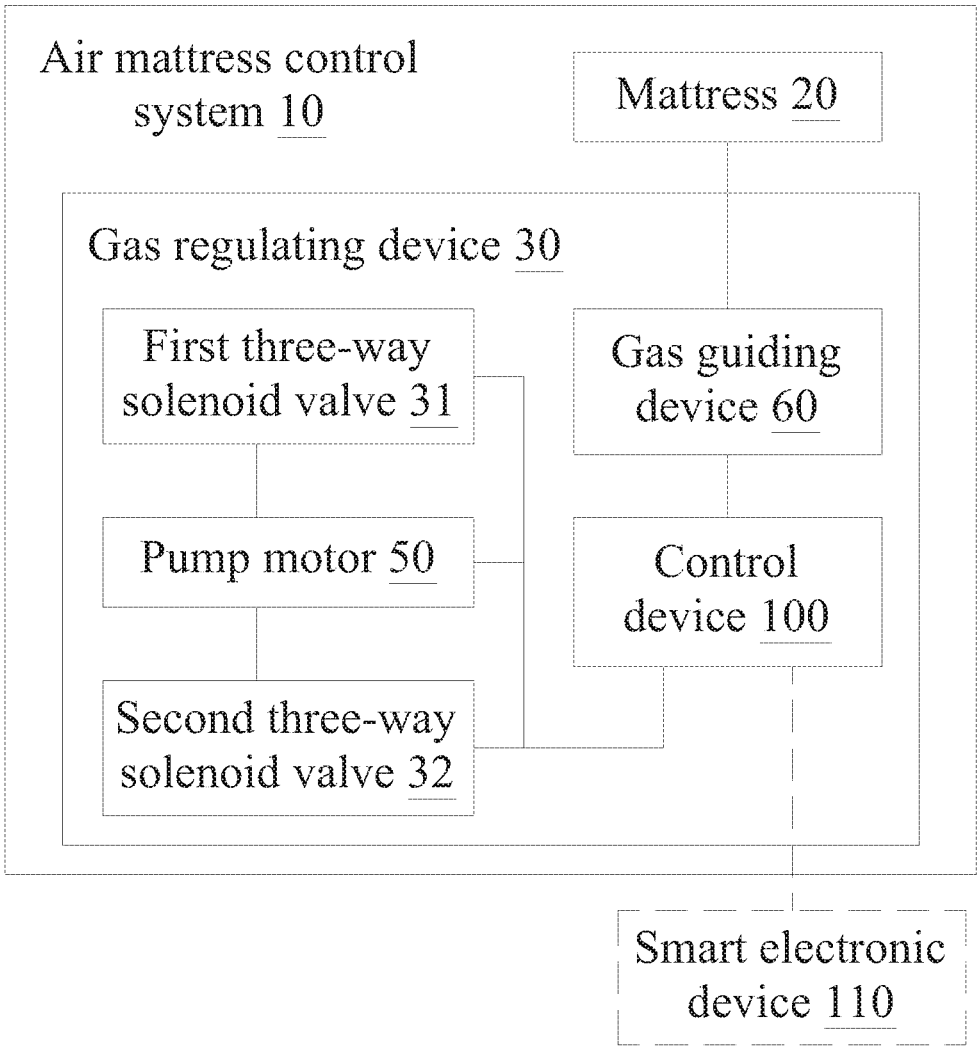
FIG. 1 is a block diagram of an air mattress control system in accordance with an embodiment of the invention.

In the present invention, it should be noted that the terms "the first," "the second," "the third," "the fourth," "configure," "concave," "connect," "accommodating," "combine," and "drive" should be generally understood unless there is a specific regulation or restriction. The specific meanings of the aforementioned terms in the present invention shall specifically be understood by a person of ordinary skill in the art.

The embodiments of the air mattress control system 10 of the present invention are to be explained with reference to the related drawings. For ease of understanding, the same elements in the following embodiments are symbolized by the same reference numerals.

With reference to FIG. 1, a block diagram of an air mattress control system in accordance with an embodiment of the invention is depicted. The air mattress control system 10 is provided and comprises a mattress 20 and a gas regulating device 30. The mattress 20 comprises a plurality of inflation layers. The mattress 20 may be laid flat on the support frame to provide a user lying flat thereon, and the plurality of inflation layers may be assembled in parallel, stacked or a combination thereof. The gas regulating device 30 comprises a first three-way solenoid valve 31, a pumping motor 50, a second three-way solenoid valve 32, a connecting conduit 90, a gas guiding device 60, and a control device 100. The first three-way solenoid valve 31 is provided with three first input-output ports, the pumping motor 50 is connected to the first three-way solenoid valve. The pump motor 50 is configured to guide the gas to flow in one direction by driving the rotating part inside. The second three-way solenoid valve 32 is provided with three second input-output ports and the second three-way solenoid valve 32 is connected to the pumping motor 50. The first three-way solenoid valve 31 and the second three-way solenoid valve 32 may be three-way two-position solenoid valves, which can change the position of the valve and in turn change the communication path between the ports by the internal magnetic unit when the power is on. Detailed solenoid valve structure will be explained in the following embodiments. The connecting conduit may be connected to the first three-way solenoid valve 31 and the second three-way solenoid valve 32, the connecting conduit may be made of metal or plastic. The connecting conduit is used to provide an accommodating space in order to let the air flow between the first three-way solenoid valve 31, the second three-way solenoid valve 32 and the gas guiding device 60. The connecting conduit may be disposed on the same side or opposite side of the first three-way solenoid valve 31, the second three-way solenoid valve 32, and the gas guiding device 60. The connecting conduit is further connected to the plurality of inflation layers of the mattress 20 via the gas guiding device 60. The gas guiding device 60 can include a plurality of two-way solenoid valves, and the gas may be controlled to enter the plurality of inflation layers by the switch of the two-way solenoid valve.

The control device 100 is connected to the first three-way solenoid valve 31, the second three-way solenoid valve 32, the pumping motor 50 and the gas guiding device 60. The control device 100 may include control chips, control circuit, signal receiving element and signal transmitting element and therefore provided with the ability of data/information processing and signal transmission. Based on such configuration, the control device 100 is able to drive the first three-way solenoid valve 31 and the second three-way solenoid valve 32, the pumping motor 50 and the gas guiding device 60, but not limited thereto. The first three-way solenoid valve 31 and the second three-way solenoid valve 32, and the pumping motor 50 are therefore controlled by the control device 100 in order to make the pumping motor 50 to inflate or deflate the plurality of inflation layers. By means of the system configuration, the path of the air flow may be effectively changed by the switches of the first three-way solenoid valve 31 and the second three-way solenoid valve 32, so that the pumping motor 50 is able to suck the air from ambient air or from the plurality of inflation layers by a single running direction, thereby effectively controlling the inflation of plurality of inflation layers.

The air mattress control system 10 may be further operated by the smart electronic device 110. The smart electronic device 110 may be a smart phone, a tablet, etc., but not limited thereto. The smart electronic device 110 may also be other mobile device with wireless transmission function. The smart electronic device 110 is coupled to the control device 100, the smart electronic device 110 may transmit the inflation signal to the control device 100, and the control device 100 may further transmit the inflation signal to drive the first three-way solenoid valve 31 and the second three-way solenoid valve 32 of the air mattress control system 10 to operate in an inflation mode. The smart electronic device 110 may also transmit the deflation signal to the control device 100, and the control device 100 may further transmit the deflation signal to drive the first three-way solenoid valve 31 and the second three-way solenoid valve 32 of the air mattress control system 10 to operate in a deflation mode.

For example, the user can not only use the control device 100 to generate the inflation or deflation signal, but also able to use the smart electronic device 110 to generate the inflation or deflation signal remotely to the control device 100, such that the first three-way solenoid valve 31 and the second three-way solenoid valve 32 may be driven by the control device 100 according to the inflation or deflation signal.

Figure 2:
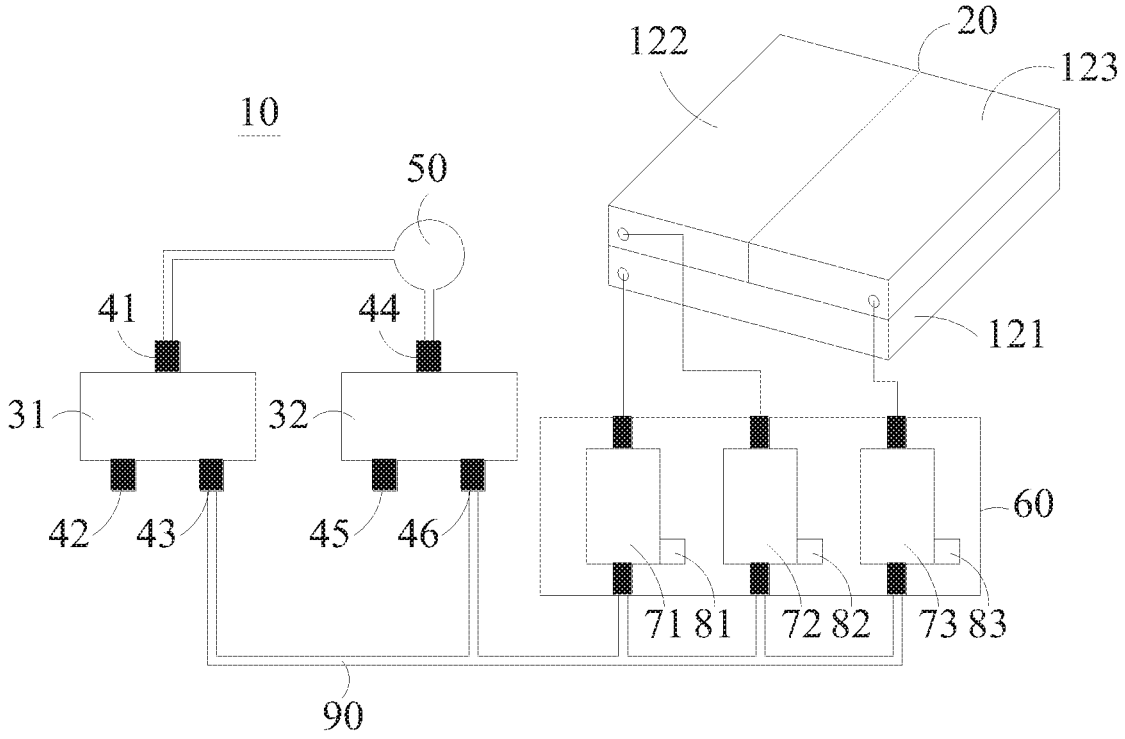
FIG. 2 is an initial state schematic diagram of an air mattress control system in accordance with an embodiment of the invention.

With reference to FIG. 2 for an initial state schematic diagram of an air mattress control system in accordance with an embodiment of the invention. The three first input-output ports may include a first valve hole 41 disposed on one side of the first three-way solenoid valve 31, a second valve hole 42 and a third valve hole 43 disposed on one other side of the first three-way solenoid valve 31, the three second input-output ports may include a fourth valve hole 44 disposed on one side of the second three-way solenoid valve 32, a fifth valve hole 45 and a sixth valve hole 46 disposed on one other side of the second three-way solenoid valve 32. The first valve hole 41 and the fourth valve hole 44 are connected to the pump motor 50 respectively, the second valve hole 42 and the fifth valve hole 45 are connected to ambient air respectively, and the third valve hole 43 and the sixth valve hole 46 are connected to the connecting conduit 90 respectively.

The gas guiding device 60 may be provided with a first two-way solenoid valve 71, a second two-way solenoid valve 72 and a third two-way solenoid valve 73. The two-way solenoid valve may be a two-way two-position solenoid valve, in which the internal magnetic unit of the solenoid valve can change the position of the valve when the power is provided in order to control whether the two valve holes of the two-way solenoid valve are in communication or not. The first two-way solenoid valve 71 is connected to the connecting conduit 90 and the mattress 20 respectively via two openings of the first two-way solenoid valve 71, the second two-way solenoid valve 72 is connected to the connecting conduit 90 and the mattress 20 respectively via two openings of the second two-way solenoid valve 72 and the third two-way solenoid valve 73 is connected to the connecting conduit 90 and the mattress 20 respectively via two openings of the third two-way solenoid valve 73. The control device 100 can transmit a first control signal to drive the first two-way solenoid valve 71 to open or block the two openings of the first two-way solenoid valve 71, the control device 100 can transmit a second control signal to drive the second two-way solenoid valve 72 to open or block the two openings of the second two-way solenoid valve 72, and the control device 100 can transmit a third control signal to drive the third two-way solenoid valve 73 to open or block the two openings of the third two-way solenoid valve 73. By this configuration, the communication of the two openings of the two-way solenoid valve may be effectively controlled by the control device 100.

The first three-way solenoid valve 31 and the second three-way solenoid valve 32 of the gas regulating device 30 may be arranged side by side, and the first two-way solenoid valve 71, the second two-way solenoid valve 72 and the third two-way solenoid valve 73 may be arranged side by side in different directions and next to the first three-way solenoid valve 31 and the second three-way solenoid valve 32. Besides, the gas regulating device 30 can further comprise an accommodation piece. The assembled components of the gas regulating device 30 may be placed in the accommodation piece, which can not only save the space, but also be convenient for the user to carry and use.

The air mattress control system 10 may further comprise a first pneumatic sensing element 81, a second pneumatic sensing element 82 and a third pneumatic sensing element 83. Each pneumatic sensing element may be piezoresistive, capacitive, film-forming, resistive or mechanical. The first pneumatic sensing element 81 is connected to the first two-way solenoid valve 71, the second pneumatic sensing element 82 is connected to the second two-way solenoid valve 72 and the third pneumatic sensing element 83 is connected to the third two-way solenoid valve 73. The first pneumatic sensing element 81 detects the air pressure in the first two-way solenoid valve 71 to generate a first air pressure message and further transmits to the control device 100, the second pneumatic sensing element 82 detects the air pressure in the second two-way solenoid valve 72 to generate a second air pressure message and further transmits to the control device 100 and the third pneumatic sensing element 83 detects the air pressure in the third two-way solenoid valve 73 to generate a third air pressure message and further transmits to the control device 100.

When the first air pressure message matches a first default message of the control device 100, the control device 100 drives the second two-way solenoid valve 72 and the third two-way solenoid valve 73 to be closed. When the second air pressure message matches a second default message of the control device 100, the control device 100 drives the first two-way solenoid valve 71 and the third two-way solenoid valve 73 to be closed. When the third air pressure message matches a third default message of the control device 100, the control device 100 drives the first two-way solenoid valve 71 and the second two-way solenoid valve 72 to be closed.

For example, when the first pneumatic sensing element 81 senses the air pressure changes resulted from the open of the first two-way solenoid valve 71 by the control device 100, the first air pressure message is generated and transmitted to the control device 100, and when the first air pressure message matches the first default message of the control device 100 which contains the pressure value corresponding to the gas delivered to the inflation layer, the control device 100 drives the second two-way solenoid valve 72 and the third two-way solenoid valve 73 to be closed in order to ensure that the second two-way solenoid valve 72 and the third two-way solenoid valve 73 are not able to let the gas pass through to the corresponding inflation layers, therefore preventing inflation layers with inclined angles to be simultaneously inflated, thereby preventing from hurting the user lying therein.

When at least one of the first air pressure message, the second air pressure message and the third air pressure message matches an abnormal signal of the control device 100, the control device 100 drives the first two-way solenoid valve 71, the second two-way solenoid valve 72 and the third two-way solenoid valve 73 to be closed.

For example, when the first pneumatic sensing element 81 senses the air pressure changes resulted from the open of the first two-way solenoid valve 71 by the control device 100, the first air pressure message is generated and transmitted to the control device 100, and when the first air pressure message matches the abnormal message of the control device 100, the control device 100 determines that this is an abnormal situation and drives the first two-way solenoid valve 71, the second two-way solenoid valve 72 and the third two-way solenoid valve 73 to be closed in order not to inflate inflation layers while it is in the abnormal situation. The abnormal message may be generated when a sensed pressure value is too high or too low compared to the normal pressure value, so when the first air pressure message meets the condition for generating the abnormal message, it indicates that the pressure value of the first air pressure message is too high or too low.

Furthermore, the air pressure message generated by sensing the pressure change resulted from the two corresponding solenoid valves via each pneumatic sensing element may be transmitted to the smart electronic device 110 by the control device 100, and the smart electronic device 110 may present the air pressure message by text, picture, sound or a combination thereof after calculation. Hence, the users can confirm the detail data of current inflation or deflation by checking the air pressure message presented by the smart electronic device 110.

The plurality of inflation layers of the mattress 20 may be provided with a first inflation layer 121 connected to the first two-way solenoid valve 71, a second inflation layer 122 connected to the second two-way solenoid valve 72 and a third inflation layer 123 connected to the third two-way solenoid valve 73. The second inflation layer 122 is disposed at one surface of the first inflation layer 121 and arranged to be near one side of the first inflation layer 121, the third inflation layer 123 is disposed at one surface of the first inflation layer 121 and arranged to be near one other side of the first inflation layer 121.

For example, in the inflation mode, the first inflation layer 121 may have a flat surface after inflation, so that the user's body weight may be effectively supported to prevent the user from directly contacting hard supporting plates of the bed. The second inflation layer 122 and the third inflation layer 123 above the first inflation layer 121 may form an inclined surface after being inflated, so when one of the second inflation layer 122 or the third inflation layer 123 expands due to the inflation, the user can easily turn over his body because his body is tilted by the assistant of the inflation layer.

In addition, the number of inflation layers of the air mattress control system 10 of the present invention is not limited to three, and the number of inflation layers is corresponding to the number of two-way solenoid valves. For example, when the number of inflation layers is two, the system only needs to have two two-way solenoid valves, and the control message transmitted by the control device 100 includes the first control signal and the second control signal, and the operation of the inflation or deflation is the same as the inflation mode or deflation mode described as following.

Figure 3:
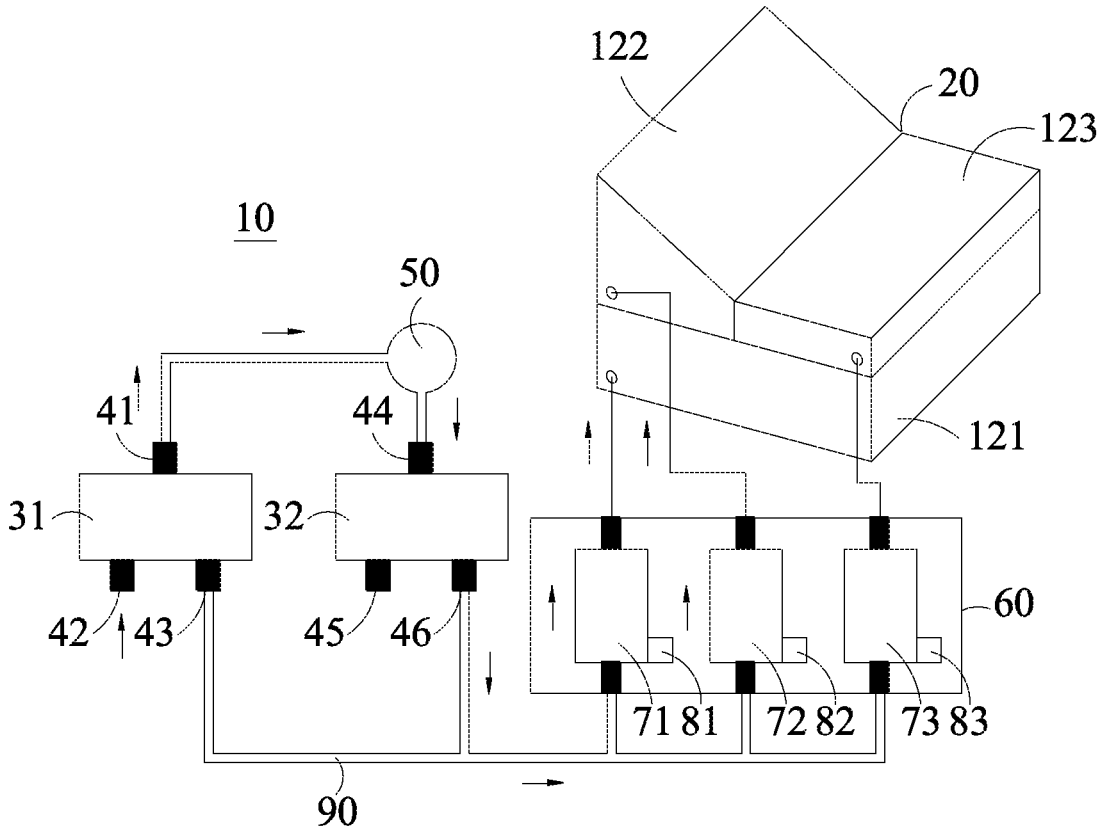
FIG. 3 is an inflation mode schematic diagram of an air mattress control system in accordance with an embodiment of the invention.

With reference to FIG. 3 for an inflation mode schematic diagram of an air mattress control system in accordance with an embodiment of the invention. The air mattress control system 10 of the present invention may be provided with an inflation mode and a deflation mode. In the inflation mode, the control device 100 transmits an inflation signal to drive the first three-way solenoid valve 31 to close the third valve hole 43, and drive the second three-way solenoid valve 32 to close the fifth valve hole 45, whereas the first valve hole 41 and the second valve hole 42 remain unblocked, and the fourth valve hole 44 and the sixth valve hole 46 remain unblocked. And the control device 100 transmits the inflation signal to activate the pump motor 50, and the pump motor 50 pumps the gas from ambient air into the second valve hole 42. The gas is then sequentially transmitted to the plurality of inflation layers via the first valve hole 41, the pump motor 50, the fourth valve hole 44, the sixth valve hole 46, the connecting conduit 90 and the gas guiding device 60. The plurality of inflation layers are then inflated by the gas. In the FIG. 3, the first inflation layer 121 is inflated first by controlling the first two-way solenoid valve 71, and then the second inflation layer 122 is inflated by controlling the second two-way solenoid valve 72, but not limited thereto. The first inflation layer 121 may be inflated first by controlling the first two-way solenoid valve 71 first, and then the third inflation layer 123 may be inflated by controlling the third two-way solenoid valve 73 thereafter.

For example, the user can transmit the first control signal by the control device 100 to drive the first two-way solenoid valve 71 to be turned on, and the inflation signal is transmitted by the control device 100 to drive the first three-way solenoid valve 31 to close the third valve hole 43 and the second three-way solenoid valve 32 to close the fifth valve hole 45, and the control device 100 transmits the inflation signal to activate the pump motor 50, and the pump motor 50 is used to drive the gas in the ambient air into the plurality of inflation layers through the second valve hole 42, and the gas is then sequentially transmitted via the first valve hole 41, the pump motor 50, the fourth valve hole 44, the sixth valve hole 46, the connecting conduit 90 and the first two-way solenoid valve 71 to the first inflation layer 121. When the first inflation layer 121 is fully inflated, the user can transmit the first control signal by the control device 100 to drive the first two-way solenoid valve 71 to be turned off and stop transmitting the inflation signal to turn off the pump motor 50. The inflated first inflation layer 121 may consequently provide the user lying flatly thereon, and the first inflation layer 121 can effectively support the user's body weight and effectively reduce the pressure on parts that are easily stressed thereby to avoid decubitus. When the user needs to turn over toward to direction of the third inflation layer 123, the user can transmit the second control signal by the control device 100 to drive the second two-way solenoid valve 72 to be turned on, and the control device 100 transmits the inflation signal to activate the pump motor 50, the pump motor 50 can drive the gas through the second two-way solenoid valve 72 into the second inflation layer 122. When the second inflation layer 122 is inflated, the user can transmit the second control signal by the control device 100 to drive the second two-way solenoid valve 72 to be turned off and stop transmitting the inflation signal to turn off the pump motor 50. The second inflation layer 122 is consequently inflated and forms an inclined surface, so that it can assist the user to turn his body over toward the direction of the third inflation layer 123.

Figure 4:
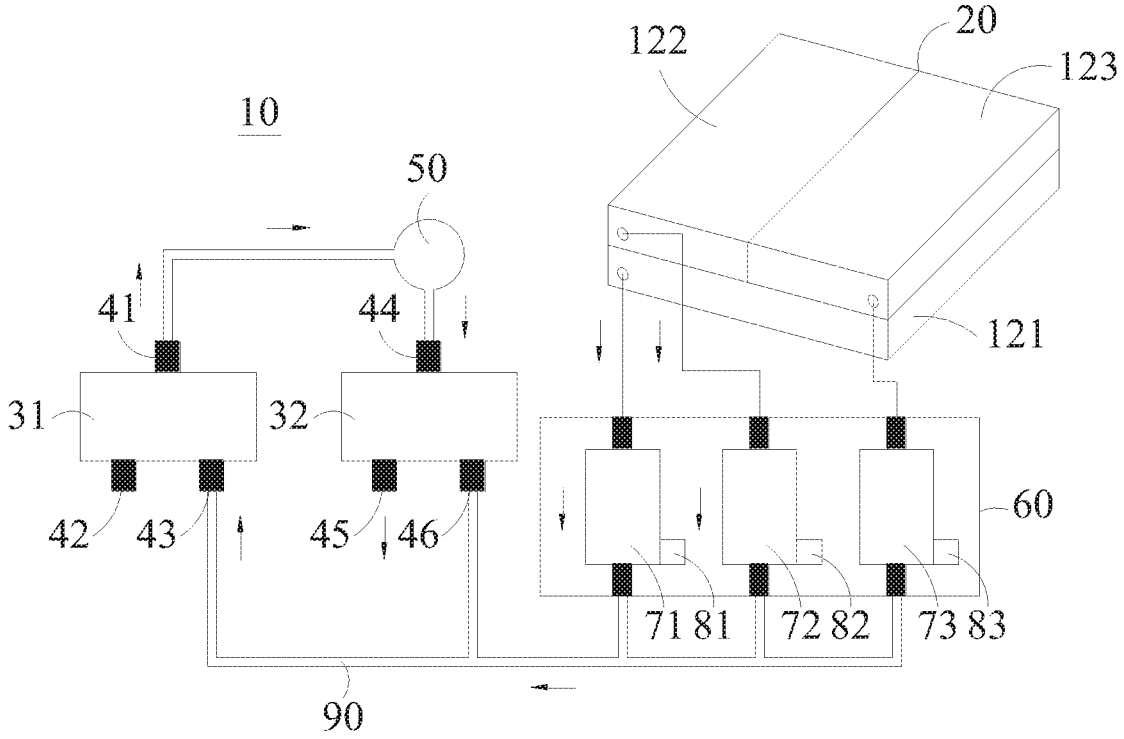
FIG. 4 is a deflation mode schematic diagram of an air mattress control system in accordance with an embodiment of the invention.

With reference to FIG. 4 for a deflation mode schematic diagram of an air mattress control system in accordance with an embodiment of the invention. When the air mattress control system 10 is in a deflation mode, the control device 100 transmits a deflation signal to drive the first three-way solenoid valve 31 to close the second valve hole 42, and drive the second three-way solenoid valve 32 to close the sixth valve hole 46, whereas the first valve hole 41 and the third valve hole 43 remain unblocked, and the fourth valve hole 44 and the fifth valve hole 45 remain unblocked. The control device 100 transmits the deflation signal to activate the pump motor 50, and the pump motor 50 pumps the gas from the plurality of inflation layers into the gas guiding device 60. The gas is then sequentially transmitted to ambient air via the connecting conduit 90, the third valve hole 43, the first valve hole 41, the pump motor 50, the fourth valve hole 44 and the fifth valve hole 45. At this time, the plurality of inflation layers are returned to the initial state due to the internal gas being introduced into ambient air. As shown in FIG. 4, the deflation of the second inflation layer 122 is achieved by controlling the second two-way solenoid valve 72, and the deflation of the first inflation layer 121 is achieved by controlling the first two-way solenoid valve 71, but not limited thereto. The deflation of the third inflation layer 123 may be achieved first by controlling the third two-way solenoid valve 73 and the deflation of the first inflation layer 121 may then be achieved by controlling the first two-way solenoid valve 71.

For example, the first inflation layer 121 and the second inflation layer 122 are inflated in the inflation mode by the control of the control device 100. When the user does not need to use the inflated mattress 20, the user can manipulate the control device 100 to transmit the first control signal to drive the first two-way solenoid valve 71 to be turned on, and the control device 100 would transmit the deflation signal to drive the first three-way solenoid valve 31 to close the second valve hole 42, and drive the second three-way solenoid valve 32 to close the sixth valve hole 46, and the control device 100 would transmit the deflation signal to drive the pump motor 50. The pump motor 50 would pump the gas from the first inflation layers 121 through the first two-way solenoid valve 71. The gas would then sequentially be transmitted to the ambient air via the connecting conduit 90, the third valve hole 43, the first valve hole 41, the pump motor 50, the fourth valve hole 44 and the fifth valve hole 45. The second control signal is transmitted by the control device 100 to drive the second two-way solenoid valve 72 to be turned on in order to let the pump motor 50 pump the gas from the second inflation layers 122 through the second two-way solenoid valve 72. The gas is then sequentially transmitted to ambient air via the connecting conduit 90, the third valve hole 43, the first valve hole 41, the pump motor 50, the fourth valve hole 44 and the fifth valve hole 45. Consequently, the first and the second inflation layers are returned to the initial state due to the internal gas being introduced into the ambient air.

Figure 5:
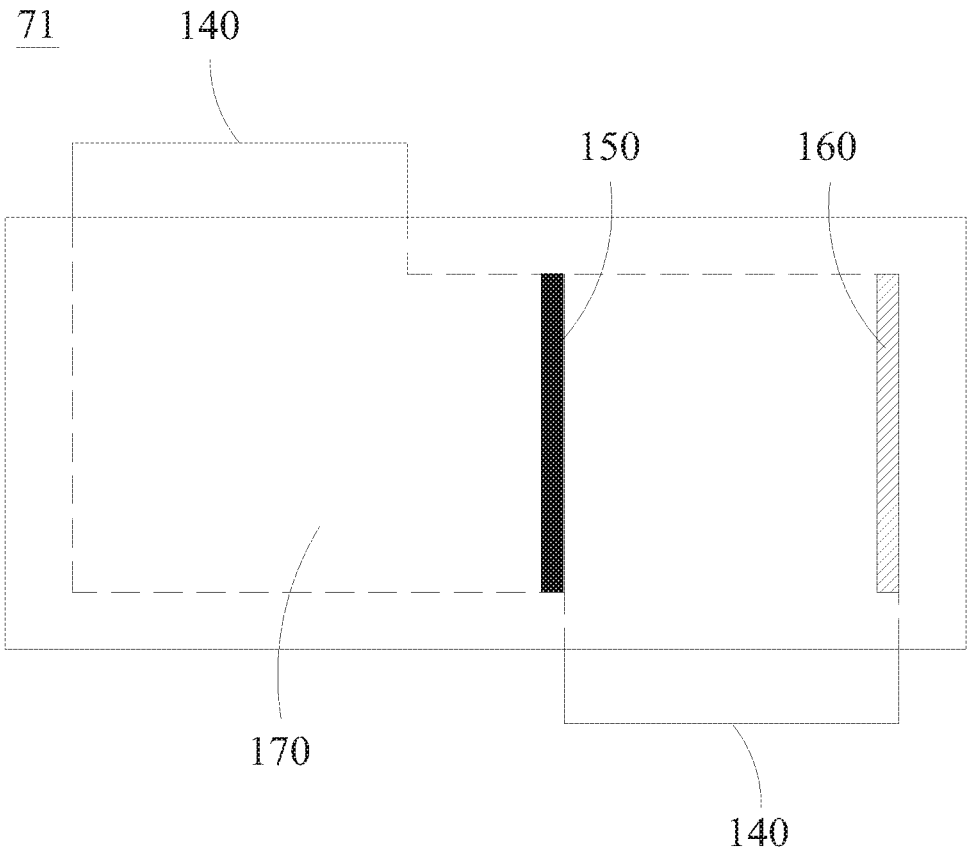
FIG. 5 is a solenoid valve schematic diagram of an air mattress control system in accordance with an embodiment of the invention.

With reference to FIG. 5 for a solenoid valve schematic diagram of an air mattress control system in accordance with an embodiment of the invention. FIG. 5 illustrates a schematic diagram of the first two-way solenoid valve 71. The two openings 140 of the first two-way solenoid valve 71 are respectively disposed on both sides thereof. A gas flow path 170 therein has a movable valve 150, and a magnetic unit 160 is disposed at one side of the gas flow path 170. When the control device 100 transmits the first control signal to the first two-way solenoid valve 71, the magnetic unit 160 of the first two-way solenoid valve 71 will push the movable valve 150 toward an opposite direction of the magnetic unit 160 by the magnetic force, and the two openings 140 is now open. When the control device 100 transmits the first control signal to the first two-way solenoid valve 71 again, the magnetic unit 160 of the first two-way solenoid valve 71 will attract the movable valve 150 toward the direction of the magnetic unit 160 by the magnetic force in order to make the movable valve 150 stay at the initial position, and the two openings 140 are now closed. Similarly, the three-way solenoid valve may have two movable valves being designed on both sides, so that one side is provided with one valve hole and the other side is provides with two valve holes. The alternation of opening and closing the valve holes of the three-way solenoid valve may be achieved by the switch of the two movable valves. According to the air mattress control system 10 of the present invention, the first three-way solenoid valve 31, the second three-way solenoid valve 32, the first two-way solenoid valve 71, the second two-way solenoid valve 72, and the third two-way solenoid valve 73 are all designed by this configuration to change the gas flow path after receiving the signal.

The invention improves over the prior art and complies with patent application requirements, and thus is duly filed for patent application. While the invention has been described by device of specific embodiments, numerous modifications and variations could be made thereto by those generally skilled in the art without departing from the scope and spirit of the invention set forth in the claims.

What is claimed is:

1. An air mattress control system comprising:

a mattress comprising a plurality of inflation layers; and a gas regulating device comprising:

a first three-way solenoid valve comprising three first input-output ports;

a pumping motor connected to the first three-way solenoid valve;

a second three-way solenoid valve comprising three second input-output ports, and the second three-way solenoid valve being connected to the pumping motor;

a connecting conduit connected to the first three-way solenoid valve and the second three-way solenoid valve;

a gas guiding device connected to the connecting conduit and the plurality of inflation layers; and a control device connected to the first three-way solenoid valve, the second three-way solenoid valve, the pumping motor and the gas guiding device;

wherein the control device controls the first three-way solenoid valve and the second three-way solenoid valve in order to make the pumping motor to inflate or deflate the plurality of inflation layers;

wherein the gas guiding device comprises a first two-way solenoid valve connected to the connecting conduit and the mattress respectively via two openings of the first two-way solenoid valve, a second two-way solenoid valve connected to the connecting conduit and the mattress respectively via two openings of the second two-way solenoid valve and a third two-way solenoid valve connected to the connecting conduit and the mattress respectively via two openings of the third two-way solenoid valve, the control device transmits a first control signal to drive the first two-way solenoid valve to open or block the two openings of the first two-way solenoid valve, the control device transmits a second control signal to drive the second two-way solenoid valve to open or block the two openings of the second two-way solenoid valve, and the control device transmits a third control signal to drive the third two-way solenoid valve to open or block the two openings of the third two-way solenoid valve.

2. The air mattress control system as recited in claim 1, wherein the three first input-output ports comprise a first valve hole disposed on one side of the first three-way solenoid valve, a second valve hole and a third valve hole disposed on one other side of the first three-way solenoid valve, the three second input-output ports comprise a fourth valve hole disposed on one side of the second three-way solenoid valve, a fifth valve hole and a sixth valve hole disposed on one other side of the second three-way solenoid valve, the first valve hole and the fourth valve hole are connected to the pump motor respectively, the second valve hole and the fifth valve hole are connected to ambient air respectively, and the third valve hole and the sixth valve hole are connected to the connecting conduit respectively.

3. The air mattress control system as recited in claim 2, wherein when the air mattress control system is in an inflation mode, the control device transmits an inflation signal to drive the first three-way solenoid valve to close the third valve hole, and drive the second three-way solenoid valve to close the fifth valve hole, whereas the first valve hole and the second valve hole remain unblocked, and the fourth valve hole and the sixth valve hole remain unblocked, and the control device transmits the inflation signal to activate the pump motor, and the pump motor pumps the gas from the ambient air into the second valve hole and the gas is sequentially transmitted to the plurality of inflation layers via the first valve hole, the pump motor, the fourth valve hole, the sixth valve hole, the connecting conduit and the gas guiding device.

4. The air mattress control system as recited in claim 2, wherein when the air mattress control system is in a deflation mode, the control device transmits a deflation signal to drive the first three-way solenoid valve to close the second valve hole and drive the second three-way solenoid valve to close the sixth valve hole, whereas the first valve hole and the third valve hole remain unblocked, the fourth valve hole and the fifth valve hole remain unblocked, and the control device transmits the deflation signal to activate the pump motor, and the pump motor pumps the gas from the plurality of inflation layers into the gas guiding device and the gas is sequentially transmitted to the ambient air via the connecting conduit, the third valve hole, the first valve hole, the pump motor, the fourth valve hole and the fifth valve hole.

5. The air mattress control system as recited in claim 3, further comprising a smart electronic device coupled to the control device, wherein the smart electronic device transmits the inflation signal to the control device, and the control device further transmits the inflation signal to drive the first three-way solenoid valve and the second three-way solenoid valve to make the air mattress control system enter the inflation mode.

6. The air mattress control system as recited in claim 4, further comprising a smart electronic device coupled to the control device, wherein the smart electronic device transmits the deflation signal to the control device, and the control device further transmits the deflation signal to drive the first three-way solenoid valve and the second three-way solenoid valve to make the air mattress control system enter the deflation mode.

7. The air mattress control system as recited in claim 1, further comprising a first pneumatic sensing element connected to the first two-way solenoid valve, a second pneumatic sensing element connected to the second two-way solenoid valve and a third pneumatic sensing element connected to the third two-way solenoid valve, wherein the first pneumatic sensing element detects the first two-way solenoid valve to generate a first air pressure message and further transmits to the control device, the second pneumatic sensing element detects the second two-way solenoid valve to generate a second air pressure message and further transmits to the control device and the third pneumatic sensing element detects the third two-way solenoid valve to generate a third air pressure message and further transmits to the control device.

8. The air mattress control system as recited in claim 7, wherein when the first air pressure message matches a first default message of the control device, the control device drives the second two-way solenoid valve and the third two-way solenoid valve to be closed, wherein when the second air pressure message matches a second default message of the control device, the control device drives the first two-way solenoid valve and the third two-way solenoid valve to be closed, wherein when the third air pressure message matches a third default message of the control device, the control device drives the first two-way solenoid valve and the second two-way solenoid valve to be closed.

9. The air mattress control system as recited in claim 7, wherein when at least one of the first air pressure message, the second air pressure message and the third air pressure message matches an abnormal signal of the control device, the control device drives the first two-way solenoid valve, the second two-way solenoid valve and the third two-way solenoid valve to be closed.

10. The air mattress control system as recited in claim 7, further comprising a smart electronic device coupled to the control device, wherein the control device transmits the first air pressure message, the second air pressure message and the third air pressure message to the smart electronic device and the smart electronic device presents the first air pressure message, the second air pressure message or the third air pressure message by text, picture, sound or a combination thereof.

11. The air mattress control system as recited in claim 1, wherein the plurality of inflation layers comprise a first inflation layer connected to the first two-way solenoid valve, a second inflation layer connected to the second two-way solenoid valve and a third inflation layer connected to the third two-way solenoid valve.

12. The air mattress control system as recited in claim 11, wherein the second inflation layer is disposed at one surface of the first inflation layer and arranged to be near one side of the first inflation layer, the third inflation layer is disposed at the one surface of the first inflation layer and arranged to be near one other side of the first inflation layer.

* * * * *